US008943932B2

(12) United States Patent
Hsieh

(10) Patent No.: US 8,943,932 B2
(45) Date of Patent: Feb. 3, 2015

(54) ELECTRONIC TORQUE WRENCH

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 262 days.

(21) Appl. No.: 13/525,868

(22) Filed: Jun. 18, 2012

(65) Prior Publication Data

US 2013/0263707 A1 Oct. 10, 2013

(30) Foreign Application Priority Data

Apr. 10, 2012 (TW) ..... 101112621 A

(51) Int. Cl.
*B25B 23/142* (2006.01)
*B25B 23/147* (2006.01)

(52) U.S. Cl.
USPC ..... 81/467; 81/479

(58) Field of Classification Search
USPC ..... 81/467, 479; 73/862.21, 862.23
See application file for complete search history.

(56) References Cited

U.S. PATENT DOCUMENTS

| | | | | |
|---|---|---|---|---|
| 5,172,616 | A * | 12/1992 | Negishi | 81/467 |
| 5,581,042 | A * | 12/1996 | Tambini | 73/862.21 |
| 7,234,378 | B2 | 6/2007 | Reynertson, Jr. | |
| 8,201,464 | B2 * | 6/2012 | Anjanappa et al. | 73/862.21 |
| 8,272,301 | B2 * | 9/2012 | Huang | 81/479 |
| 8,485,075 | B1 * | 7/2013 | Gauthier et al. | 81/479 |

FOREIGN PATENT DOCUMENTS

| | | |
|---|---|---|
| TW | M398996 | 3/2011 |
| TW | I356752 | 1/2012 |

* cited by examiner

*Primary Examiner* — Hadi Shakeri
(74) *Attorney, Agent, or Firm* — Guice Patents PLLC

(57) ABSTRACT

An electronic torque wrench includes a main body, a display device and at least one pushbutton module. A torque detector is disposed on the main body in adjacency to a working head for outputting a torque value. The display device has an operation unit and a display panel. The pushbutton module is for setting a torque value. The pushbutton module and the torque detector are electrically connected to the operation unit. The operation unit serves to receive and process the torque value to display the torque value on the display panel. The display panel and the pushbutton module are respectively disposed on a top side and a lateral side of the main body.

9 Claims, 7 Drawing Sheets

ELECTRONIC TORQUE WRENCH

BACKGROUND OF THE INVENTION

1. Field of the Invention

The present invention relates generally to a hand tool, and more particularly to an electronic torque wrench, which is easy to operate.

2. Description of the Related Art

FIG. 1 shows a conventional electronic wrench 10 having a main body, a working head 11 disposed at one end of the main body and a grip section 12 disposed at the other end of the main body. A panel 13 and a pushbutton set 14 are arranged on the main body in certain positions. When an operator uses the electronic wrench 10, the operator needs to press the pushbuttons of the pushbutton set 14 with both hands for setting the torque value. The pushbutton set 14 and the panel 13 for displaying the torque value are arranged on the same face of the main body. Therefore, the operator must adjust the positions and angles of his hands and head relative to the wrench for clearly observing the panel 13 and easily pressing the pushbuttons with both hands. However, the operator is not always allowed to easily operate the wrench in every working site. Therefore, in some cases, the operator may fail to clearly see the panel 13 due to a non-ideal position and angle. This will lead to an inaccurate torque value.

To overcome the above problem, Taiwan Patent No. I356752 discloses a method for turning display interface of torque tool and a device thereof. The device has a wrench main body equipped with a pivot mechanism disposed in a predetermined position. The pivot mechanism is connected with an electronic display interface for providing torque value. Taiwan Utility Model Patent No. M398996 discloses an electronic wrench fitted with a rotatable electronic counter. The electronic counter has a pushbutton interface and a display interface. The display interface is pivotally connected with the electronic counter and can be turned open. U.S. Pat. No. 7,234,378 discloses a digital torque wrench having a rotatable display unit. The display unit has a screen and multiple pushbuttons. The display unit is provided with a locating bar for locating the display unit after rotated.

In the above Patents, the display screen is pivotally swingable or rotatable to facilitate observation of the torque value. However, the operator still needs to operate the wrench with both hands. This is inconvenient. Moreover, the wrench includes additional components for achieving the object of pivotal swing or rotation. As a result, the structure of the wrench is complicated and the amount of the material of the wrench is increased. Also, the manufacturing process of the wrench is complicated and the production time is prolonged. All these will cause increase of the cost and weaken the competitive ability of enterprises in the wrench field with a sharp competition.

SUMMARY OF THE INVENTION

It is therefore a primary object of the present invention to provide an electronic torque wrench in which the display panel and the pushbutton module are separately disposed on different faces of the main body of the electronic torque wrench. Therefore, the pushbutton module can be pressed in a lateral direction of the main body, whereby an operator can conveniently operate with one single hand.

It is a further object of the present invention to provide an electronic torque wrench in which the display panel and the pushbutton module are separately arranged, whereby the area of the display panel can be enlarged or the room occupied by the display device can be reduced to reduce the weight of the wrench.

It is still a further object of the present invention to provide an electronic torque wrench in which without adding any additional structure and component, the display panel and the pushbutton module are separately arranged. Therefore, the cost for the material will not be increased and the manufacturing process of the wrench is simplified. In this case, the manufacturing cost can remain unchanged or be reduced to increase the competitive ability of enterprises in the wrench field with a sharp competition.

To achieve the above and other objects, the electronic torque wrench of the present invention includes a main body, a display device and at least one pushbutton module. A working head is disposed at one end of the main body and a grip section is disposed at the other end of the main body. A torque detector is disposed on the main body in adjacency to the working head for outputting a torque value. The display device is disposed on the main body and has an operation unit and a display panel. The pushbutton module is disposed on the main body for setting and/or displaying the torque value. The pushbutton module and the torque detector are electrically connected to the operation unit of the display device. The operation unit serves to receive and process the torque value to display the torque value on the display panel. The main body has a top side and two lateral sides. The display panel and the pushbutton module are respectively disposed on the top side of the main body and one of the lateral sides of the main body.

The main body of the electronic torque wrench is defined with a first face and a second face. The first and second faces are parallel to a longitudinal direction of the main body. The second face and the first face contain a predetermined angle. The display panel of the display device is disposed on the first face of the main body. The pushbutton module is disposed on the second face of the main body for setting and/or displaying the torque value. The pushbutton module and the torque detector are electrically connected to the operation unit of the display device. The operation unit serves to receive and process the torque value to display the torque value on the display panel.

The main body of the electronic torque wrench is defined with a first face, a second face and a third face. The first, second and third faces are all parallel to a longitudinal direction of the main body. The second face and the first face contain a predetermined angle. The third face and the first face also contain a predetermined angle. The display panel of the display device is disposed on the first face of the main body. The first pushbutton module and the second pushbutton module are respectively disposed on the second and third faces of the main body. The first pushbutton module includes a group of pushbuttons. The second pushbutton module includes at least one pushbutton. The first and second pushbutton modules are for setting and/or displaying the torque value. The pushbutton modules and the torque detector are electrically connected to the operation unit of the display device. The operation unit serves to receive and process the torque value to display the torque value on the display panel.

The present invention can be best understood through the following description and accompanying drawings, wherein:

DETAILED DESCRIPTION OF THE PREFERRED EMBODIMENTS

Figure 1:
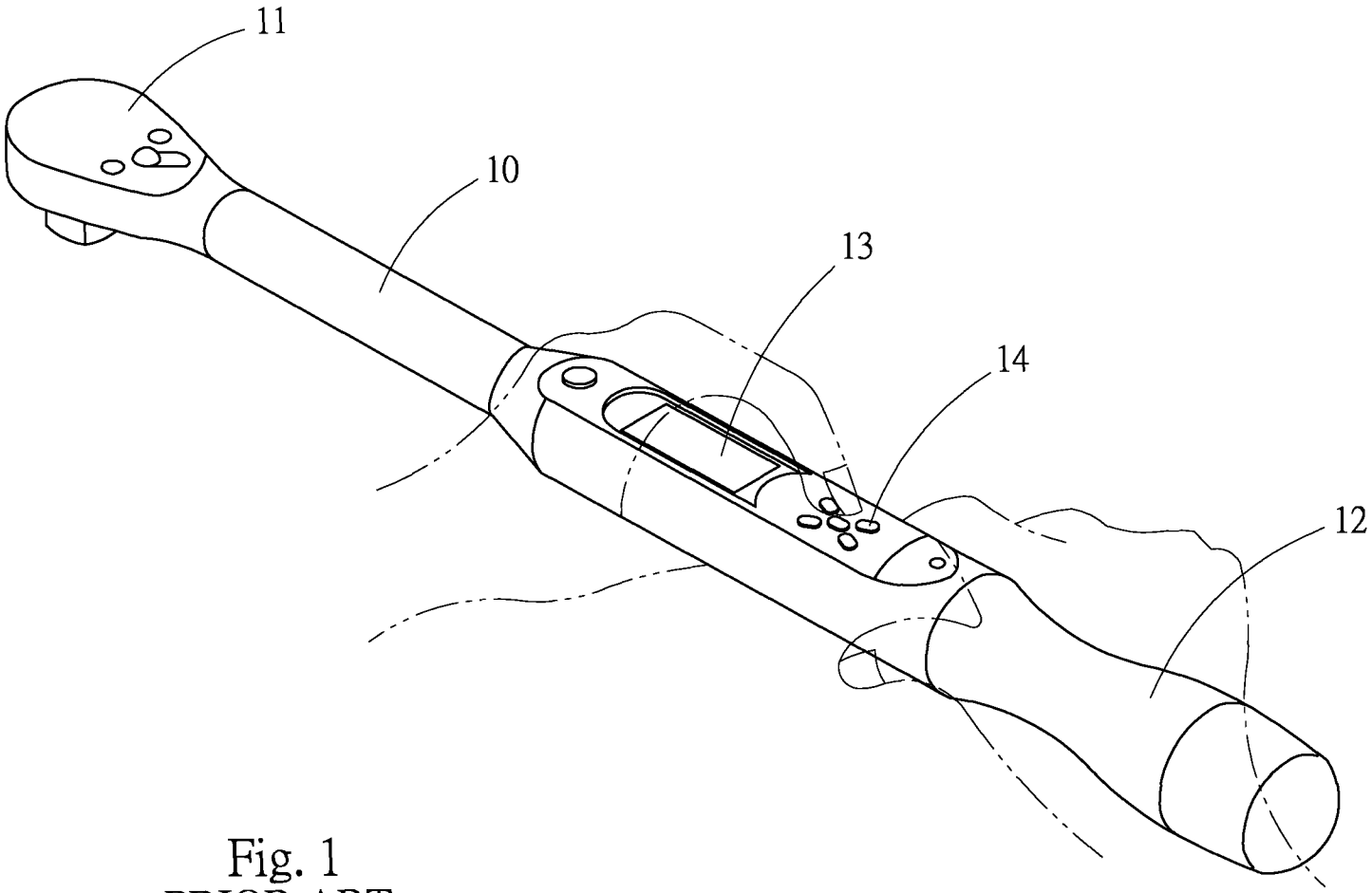
Fig. 1 PRIOR ART
FIG. 1 is a perspective view of a conventional torque wrench.
Figure 2A:
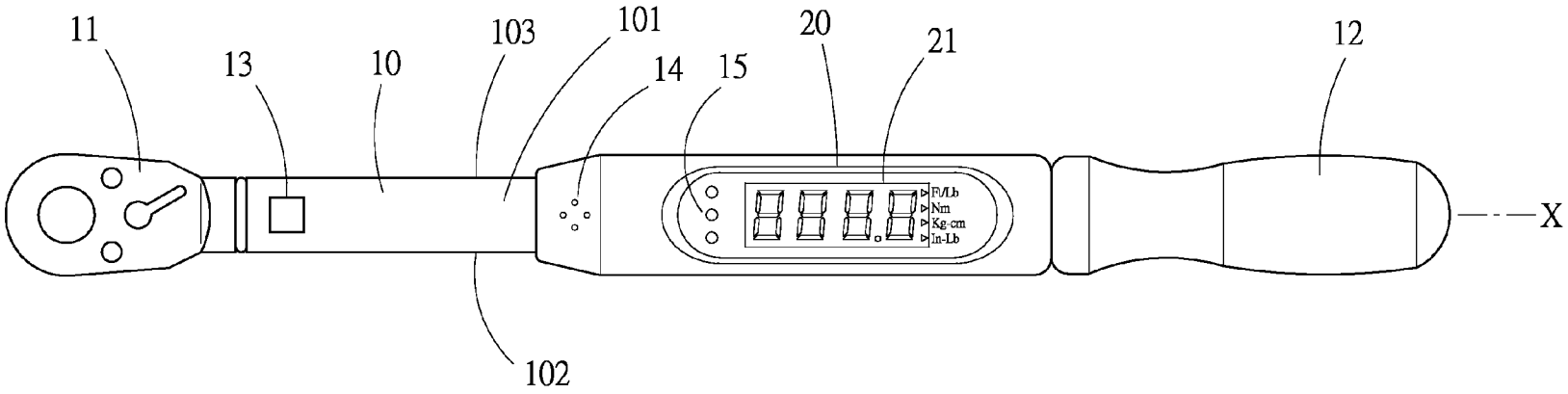
FIG. 2A is a top view of a first embodiment of the electronic torque wrench of the present invention.
Figure 2B:
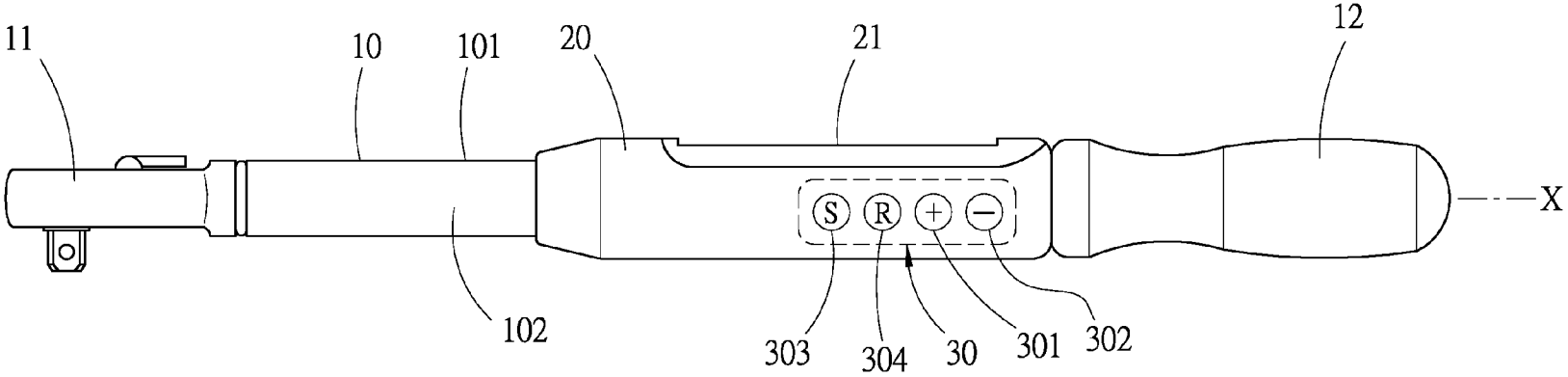
FIG. 2B is a side view of the first embodiment of the electronic torque wrench of the present invention.
Figure 3:
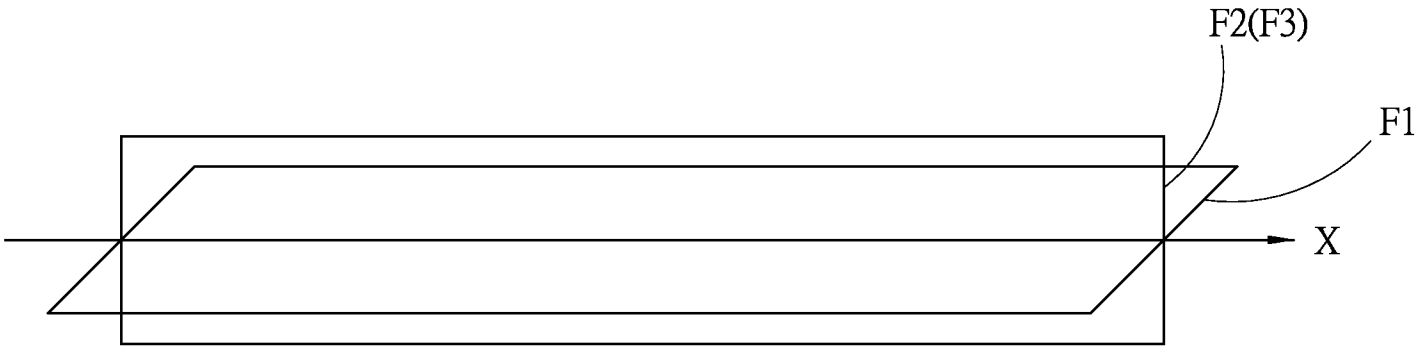
FIG. 3 is a schematic diagram showing the structural direction of the electronic torque wrench of the present invention.

Please refer to FIGS. 2A, 2B and 3. According to a first embodiment, the electronic torque wrench of the present invention has a simple structure and is easy to operate. The electronic torque wrench includes a main body 10, a display device 20 and a pushbutton module 30.

The main body 10 is defined with a longitudinal direction X. Along the longitudinal direction X, a working head 11 is disposed at one end of the main body 10 and a grip section 12 is disposed at the other end of the main body 10. A torque detector 13 is disposed on the main body in adjacency to the working head 11 for outputting a torque value. A buzzer 14 and a warning light-emitting module 15 are disposed on the main body 10 in certain positions.

In addition to the longitudinal direction X of the main body from the working head 11 to the grip section 12, the main body 10 is defined with at least three sides each of which is further defined with a plane face. As shown in FIG. 3, the main body 10 has a first face F1, a second face F2 and a third face F3. The first, second and third faces F1, F2, F3 are all parallel to the longitudinal direction X of the main body 10. The second face F2 and the first face F1 contain a predetermined angle. The third face F3 and the first face F1 also contain a predetermined angle. The relationship between the second face F2 and the third face F3 is not limited.

Please further refer to FIGS. 2A and 2B. In this embodiment, the first face F1 is formed on a top side 101 of the main body. The second and third faces F2, F3 are respectively formed on a first lateral side 102 and a second lateral side 103 of the main body 10. The second face F2 is substantially perpendicular to the first face F1 in space relationship.

The display device 20 is disposed on the main body 10 in a certain position. The display device 20 at least has an operation unit (not shown) and a display panel 21. The operation unit is inbuilt in the display device 20 for processing, comparing and calculating data. The display panel 21 serves to display data for an operator to read.

In this embodiment, the display panel 21 is disposed on the top side 101 of the main body and the pushbutton module 30 is disposed on the first lateral side 102 of the main body 10. That is, the display panel 21 is disposed on the first face F1 of the main body 10 and the pushbutton module 30 is disposed on the second face F2 of the main body 10.

The pushbutton module 30 at least includes a pushbutton for setting torque value and/or a pushbutton for displaying the torque value. The pushbutton module 30 and the torque detector 13 are electrically connected to the operation unit of the display device 20. The operation unit receives the torque value from the torque detector 13 and receives the torque value from the pushbutton module 30 and transmits the torque values to the display panel 21 for displaying the torque values for an operator to read. The operation unit can further process or compare the torque values to provide a warning effect, for example, activate the buzzer 14 or the warning light-emitting module 15.

The pushbutton module 30 includes at least one pushbutton to execute at least one function. For example, an operator can press the pushbutton to immediately display the torque value. The pushbutton module 30 can further include an increase pushbutton 301 and a decrease pushbutton 302 for setting the torque value.

As shown by the area circled by phantom line of FIG. 2B, the pushbutton module 30 includes multiple pushbuttons each of which is for executing at least one function, such as an increase pushbutton 301, a decrease pushbutton 302, a first function pushbutton 303 and a second function pushbutton 304. The function pushbutton can be a torque display pushbutton for immediately displaying the torque value, a torque save pushbutton for saving the torque value, a reset pushbutton for resetting the torque value, a unit switch pushbutton for switching the units, a power pushbutton for turning on/off the power, etc. The same pushbutton can provide multiple functions. For example, the same pushbutton can be used to switch the operation modes or switch the units. Accordingly, the operation can be more flexibly performed.

Figure 4:
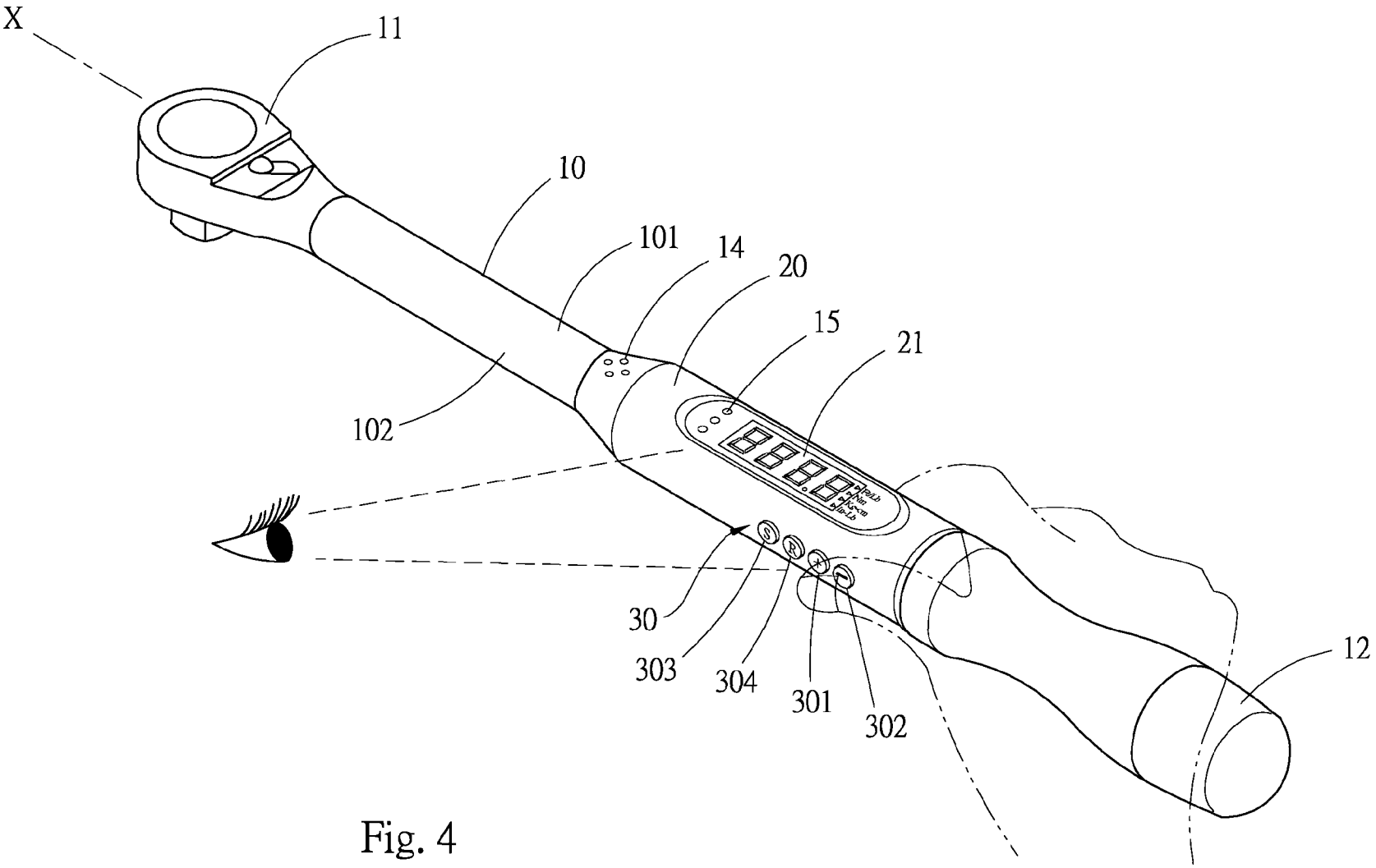
FIG. 4 is a perspective view of the first embodiment of the electronic torque wrench of the present invention, showing the operation thereof.

Please now refer to FIG. 4. The display panel and the pushbutton module are respectively disposed on the top side and the lateral side of the main body of the electronic torque wrench. The display panel is positioned on the first face F1 of the main body, while the pushbuttons of the pushbutton module are arranged on the second face F2 of the main body. According to such design, an operator can conveniently operate with one single hand and observe the display panel at the same time. As shown in FIG. 4, an operator can operate with one single hand and observe the display panel and the pushbuttons at the same time. This meets the ergonomic requirements.

Moreover, only the display panel is disposed on the top face of the main body. Therefore, in comparison with the conventional wrench in which the display panel and the pushbutton module are both arranged on the top face of the main body, the display panel of the electronic torque wrench of the present invention can be more flexibly designed. For example, the area of the display panel can be enlarged for the operator to more easily watch the display panel. Alternatively, the display panel can keep its original size with the room actually occupied by the display device reduced. In this case, the weight of the wrench can be reduced.

Figure 5A:
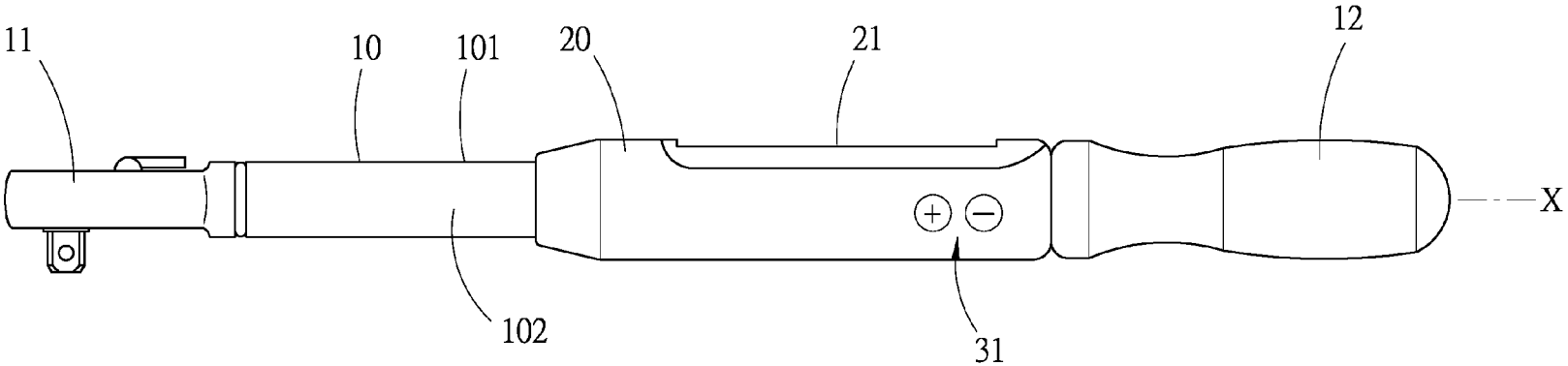
FIG. 5A is a side view of a second embodiment of the electronic torque wrench of the present invention.
Figure 5B:
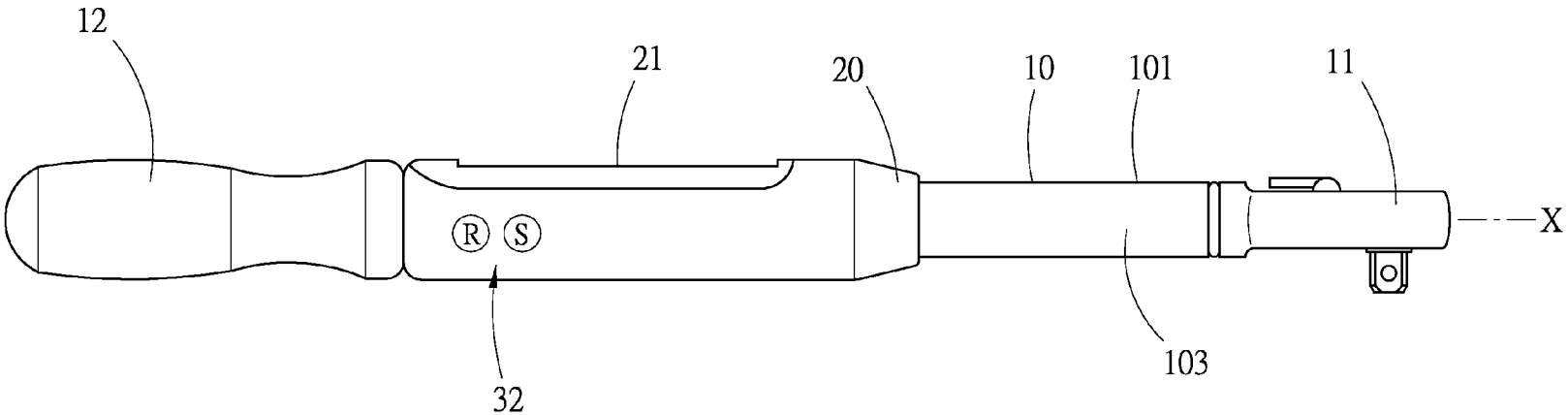
FIG. 5B is another side view of the second embodiment of the electronic torque wrench of the present invention.

Please now refer to FIGS. 5A and 5B, which show a second embodiment of the electronic torque wrench of the present invention. The second embodiment is different from the first embodiment in that:

1. The third face F3 is formed on the second lateral side 103 of the main body in parallel to the second face F2 in space relationship.
2. The second embodiment includes two pushbutton modules, that is, a first pushbutton module 31 and a second pushbutton module 32. The first and second pushbutton modules 31, 32 are respectively disposed on the first and second lateral sides 102, 103 of the main body 10 and positioned on the second and third faces F2, F3. The first pushbutton module 31 includes a group of pushbuttons such as an increase pushbutton and a decrease pushbutton. The second pushbutton module 32 includes at least one pushbutton such as a torque display pushbutton, a torque save pushbutton, a reset pushbutton, a unit switch pushbutton, a power pushbutton or any other function pushbutton. The pushbutton of the second pushbutton module 32 is different from any of the pushbuttons of the first pushbutton module 31. That is, the first and second pushbutton modules 31, 32 include two different pushbuttons (groups) with different functions.

In this embodiment, the pushbuttons of the first embodiment are classified into two pushbutton modules with pushbuttons of different functions respectively. When an operator operates with one single hand, the operator can instinctively press different pushbuttons with different fingers to achieve different functions. For example, the operator can press the increase pushbutton or the decrease pushbutton with his thumb and press the other function pushbuttons with his index finger. Accordingly, the pushbutton modules can be more flexibly used.

Figure 6A:
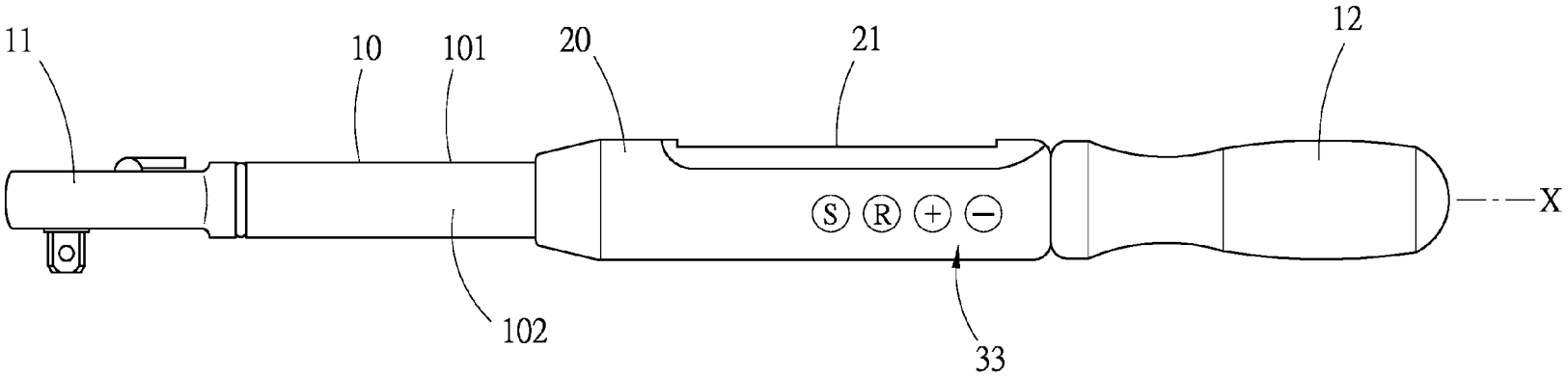
FIG. 6A is a side view of a third embodiment of the electronic torque wrench of the present invention.
Figure 6B:
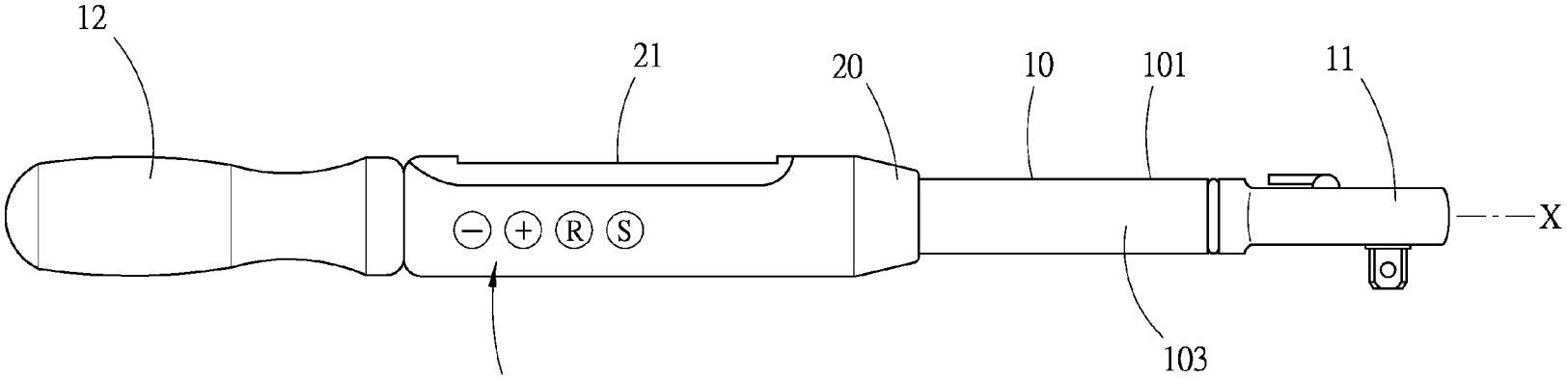
FIG. 6B is another side view of the third embodiment of the electronic torque wrench of the present invention.

Please now refer to FIGS. 6A and 6B, which show a third embodiment of the electronic torque wrench of the present invention. The third embodiment is different from the second embodiment in that:

The first pushbutton module 33 and the second pushbutton module 34 are respectively disposed on the first and second lateral sides 102, 103 of the main body 10. The first pushbutton module 33 includes a group of pushbuttons such as an increase pushbutton, a decrease pushbutton and other function pushbuttons such as a torque display pushbutton, a torque save pushbutton, a reset pushbutton, a unit switch pushbutton and a power pushbutton. The second pushbutton module 34 also includes a group of pushbuttons having the same function as at least one of the pushbuttons of the first pushbutton module 33. In this embodiment, at least one pushbutton (group) of the second pushbutton module 34 has the same function as at least one pushbutton (group) of the first pushbutton module 33.

In this embodiment, the pushbuttons with identical or similar functions are arranged on two lateral sides of the main body. This design enables an operator to more flexibly press the desired function pushbuttons with either left hand or right hand.

Figure 7A:
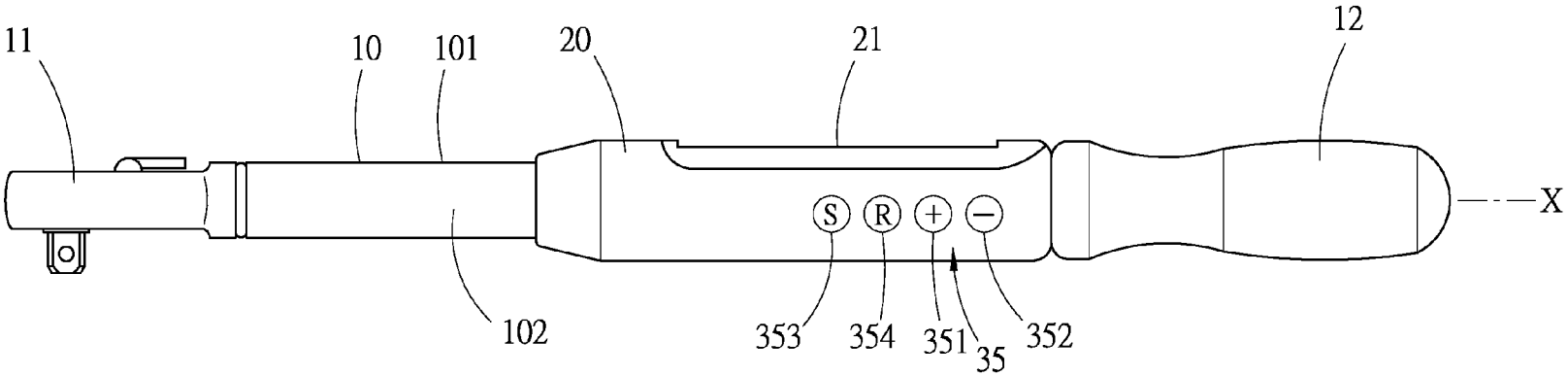
FIG. 7A is a side view of a fourth embodiment of the electronic torque wrench of the present invention.
Figure 7B:
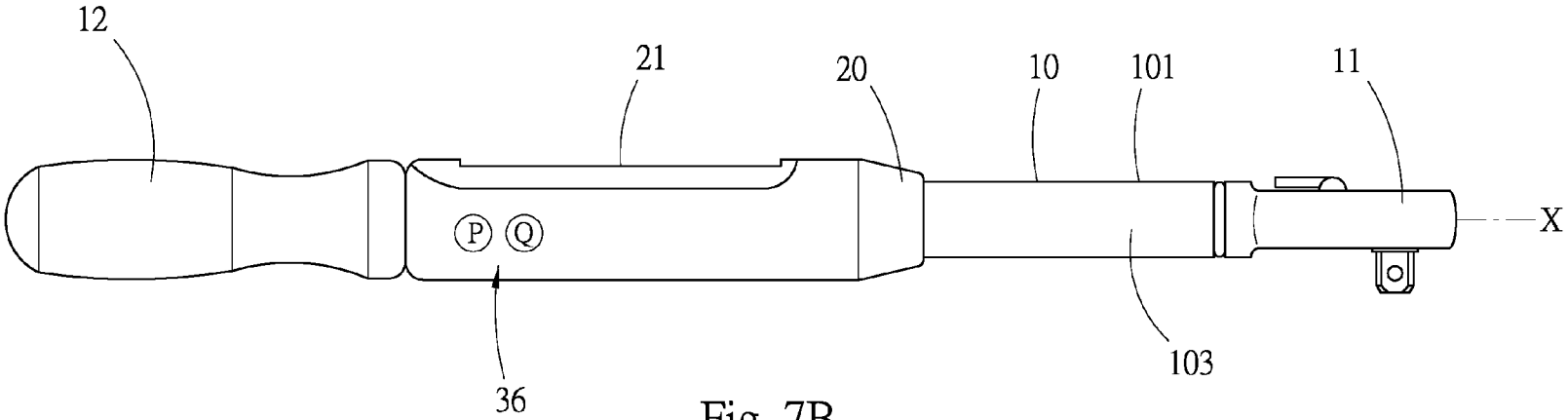
FIG. 7B is another side view of the fourth embodiment of the electronic torque wrench of the present invention.

Please now refer to FIGS. 7A and 7B, which show a fourth embodiment of the electronic torque wrench of the present invention. The fourth embodiment is different from the second embodiment in that:

A first pushbutton module 35 and a second pushbutton module 36 are respectively disposed on the first and second lateral sides 102, 103 of the main body. Each of the first and second pushbutton modules 35, 36 includes a group of pushbuttons having more function pushbuttons. It does not matter how these function pushbuttons are classified into the first and second pushbutton modules 35, 36. For example, the functions of the group of pushbuttons of the first pushbutton module 35 are identical to those of the pushbuttons of the first pushbutton module 33 of the third embodiment, that is, the increase pushbutton 351, the decrease pushbutton 352, a third function pushbutton 353 and a fourth function pushbutton 354. The second pushbutton module 36 includes other function pushbuttons different from those of the first pushbutton module 35. These function pushbuttons are not limited to the torque display pushbutton, torque save pushbutton, reset pushbutton, unit switch pushbutton and power pushbutton.

In the above embodiments, the pushbuttons can be arranged in different forms as necessary. In general, the pushbuttons of the pushbutton module are, but not limited to, linearly or side by side arranged along the longitudinal direction X of the main body. Alternatively, the pushbuttons can be randomly arranged in a predetermined section.

According to the above arrangement, the display panel and the pushbutton module are respectively disposed on the top side and the lateral side of the main body of the electronic torque wrench. Therefore, an operator can conveniently operate with one single hand and observe the display panel at the same time.

According to the electronic torque wrench of the present invention, without adding any additional structure and component, the display panel and the pushbutton module can be separately arranged. Therefore, the cost for the material will not be increased and the manufacturing process of the wrench is simplified. In this case, the manufacturing cost can remain unchanged or be reduced to increase the competitive ability of enterprises in the wrench field with a sharp competition.

Moreover, it is unnecessary to arrange the display panel and the pushbutton module on the same face. Therefore, the area of the display panel can be enlarged for the operator to more easily watch the display panel. Alternatively, the room actually occupied by the display device can be reduced to reduce the weight of the wrench.

Furthermore, in the electronic torque wrench of the present invention, the pushbuttons of the pushbutton modules can be changed and combined, whereby an operator can more conveniently and flexibly press the pushbuttons with either left hand or right hand or one single finger or multiple fingers.

The above embodiments are only used to illustrate the present invention, not intended to limit the scope thereof. Many modifications of the above embodiments can be made without departing from the spirit of the present invention.

What is claimed is:

1. An electronic torque wrench comprising:

a main body, the main body being defined with a longitudinal direction, along the longitudinal direction, the main body having a working head being located at a first end of the main body and a grip section being located at a second end of the main body, a torque detector being disposed on the main body adjacent to the working head for outputting a torque value; the main body having a first face, a second face and a third face located between the working head and the grip section, the first face, the second face and the third face being all parallel to the longitudinal direction of the main body, the second face and the first face containing a predetermined angle, the third face and the first face also containing a predetermined angle;

a display device located on the main body, the display device having an operation unit and a display panel, the operation unit processing data, the display panel being located on the first face of the main body; and a first pushbutton module and a second pushbutton module, the first pushbutton module and the second pushbutton module being respectively located on the second face and the third face of the main body, the first pushbutton module including a group of pushbuttons, the second pushbutton module including a group of pushbuttons, the first pushbutton module and second pushbutton module including pushbuttons for setting and/or displaying the torque value, each pushbutton executing at least one function; the first pushbutton module, the second pushbutton module, and the torque detector being electrically connected to the operation unit of the display device, the operation unit serving to receive and process the torque value and to display the torque value on the display panel;

wherein the display panel, the first pushbutton module, and the second pushbutton module are respectively located on the first face, the second face, and the third face of the main body and are located between the working head and the grip section and parallel to the longitudinal direction of the main body;

wherein the group of pushbuttons of the second pushbutton module includes a same number of pushbuttons as the group of pushbuttons of the first pushbutton module, the group of pushbuttons of the first pushbutton module performing the same functions as the group of pushbuttons of the second pushbutton module;

wherein the first pushbutton module and second pushbutton module include multiple pushbuttons linearly arranged along the longitudinal direction of the main body between the working head and the grip section.

2. The electronic torque wrench as claimed in claim 1, wherein the display panel is located perpendicular to the first pushbutton module and the second pushbutton module.

3. The electronic torque wrench as claimed in claim 1, wherein the first pushbutton module is located parallel to the second pushbutton module.

4. An electronic torque wrench comprising:

a main body, the main body being defined with a longitudinal direction, along the longitudinal direction, the main body having a working head being located at a first end of the main body and a grip section being located at a second end of the main body, a torque detector being disposed on the main body adjacent to the working head for outputting a torque value; the main body having a first face, a second face and a third face located between the working head and the grip section, the first face, the second face and the third face being all parallel to the longitudinal direction of the main body, the second face and the first face containing a predetermined angle, the third face and the first face also containing a predetermined angle;

a display device located on the main body, the display device having an operation unit and a display panel, the operation unit processing data, the display panel being located on the first face of the main body; and a first pushbutton module and a second pushbutton module, the first pushbutton module and the second pushbutton module being respectively located on the second face and the third face of the main body, the first pushbutton module including a group of pushbuttons, the second pushbutton module including at least one pushbutton, the first pushbutton module and second pushbutton module including pushbuttons for setting and/or displaying the torque value, each pushbutton executing at least one function; the first pushbutton module, the second pushbutton module, and the torque detector being electrically connected to the operation unit of the display device, the operation unit serving to receive and process the torque value and to display the torque value on the display panel;

wherein the display panel, the first pushbutton module, and the second pushbutton module are respectively located on the first face, the second face, and the third face of the main body and are located between the working head and the grip section and parallel to the longitudinal direction of the main body;

wherein the at least one pushbutton of the second pushbutton module and the group of pushbuttons of the first pushbutton module performing different functions;

wherein the first pushbutton module and second pushbutton module include multiple pushbuttons linearly arranged along the longitudinal direction of the main body between the working head and the grip section.

5. The electronic torque wrench as claimed in claim 4, wherein the display panel is located perpendicular to the first pushbutton module and the second pushbutton module.

6. The electronic torque wrench as claimed in claim 4, wherein the first pushbutton module is located parallel to the second pushbutton module.

7. An electronic torque wrench comprising:

a main body, the main body being defined with a longitudinal direction, along the longitudinal direction, the main body having a working head being located at a first end of the main body and a grip section being located at a second end of the main body, a torque detector being disposed on the main body adjacent to the working head for outputting a torque value; the main body having a first face, a second face and a third face located between the working head and the grip section, the first face, the second face and the third face being all parallel to the longitudinal direction of the main body, the second face and the first face containing a predetermined angle, the third face and the first face also containing a predetermined angle;

a display device located on the main body, the display device having an operation unit and a display panel, the operation unit processing data, the display panel being located on the first face of the main body; and a first pushbutton module and a second pushbutton module, the first pushbutton module and the second pushbutton module being respectively located on the second face and the third face of the main body, the first pushbutton module including a group of pushbuttons, the second pushbutton module including at least one pushbutton, the first pushbutton module and second pushbutton module including pushbuttons for setting and/or displaying the torque value, each pushbutton executing at least one function; the first pushbutton module, the second pushbutton module, and the torque detector being electrically connected to the operation unit of the display device, the operation unit serving to receive and process the torque value and to display the torque value on the display panel;

wherein the display panel, the first pushbutton module, and the second pushbutton module are respectively located on the first face, the second face, and the third face of the main body and are located between the working head and the grip section and parallel to the longitudinal direction of the main body;

wherein the at least one pushbutton of the second pushbutton module and the group of pushbuttons of the first pushbutton module perform at least one function being a same function;

wherein the first pushbutton module and second pushbutton module include multiple pushbuttons linearly arranged along the longitudinal direction of the main body between the working head and the grip section.

8. The electronic torque wrench as claimed in claim 7, wherein the display panel is located perpendicular to the first pushbutton module and the second pushbutton module.

9. The electronic torque wrench as claimed in claim 7, wherein the first pushbutton module is located parallel to the second pushbutton module.

* * * * *